US006454687B1

(12) United States Patent
Mattsson

(10) Patent No.: US 6,454,687 B1
(45) Date of Patent: Sep. 24, 2002

(54) EDGE RING FOR A PRESS ROLL

(75) Inventor: Stefan Mattsson, Kvissleby (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/462,234

(22) PCT Filed: Jun. 25, 1998

(86) PCT No.: PCT/SE98/01247

§ 371 (c)(1),
(2), (4) Date: Dec. 30, 1999

(87) PCT Pub. No.: WO99/01611

PCT Pub. Date: Jan. 14, 1999

(30) Foreign Application Priority Data

Jul. 3, 1997 (SE) ..... 9702579

(51) Int. Cl.[7] ..... B23P 15/00
(52) U.S. Cl. ..... 492/45; 492/47
(58) Field of Search ..... 492/47, 22, 20, 492/38, 45

(56) References Cited

U.S. PATENT DOCUMENTS

| | | | | |
|---|---|---|---|---|
| 4,782,568 A | | 11/1988 | Halttula | 29/123 |
| 5,484,371 A | | 1/1996 | Gautier | 492/16 |
| 6,010,443 A | * | 1/2000 | Dahlbom et al. | 492/47 |

FOREIGN PATENT DOCUMENTS

| | | |
|---|---|---|
| DE | 168534 | 3/1906 |

* cited by examiner

*Primary Examiner*—I Cuba Rosenbaum
(74) *Attorney, Agent, or Firm*—Lerner, David, Littenberg, Krumholz & Mentlik, LLP

(57) ABSTRACT

Apparatus for attachment to a press roll is disclosed, the apparatus including an edge ring extending around the edge of the press roll, the edge ring including a number of edge ring sectors dividing the edge ring diametrically and the edge ring sectors including a radial outer portion and a radial inner portion, the radial outer portion including a hook-shaped portion to form a cap joint with the edge of the press roll.

4 Claims, 2 Drawing Sheets

EDGE RING FOR A PRESS ROLL

FIELD OF THE INVENTION

The present invention relates to an edge ring for a press roll.

BACKGROUND OF THE INVENTION

In roll presses, the pulp suspension is generally dewatered between two press rolls. On their peripheries, these press rolls are equipped with perforated shell plating on which, if appropriate, cloth-type mesh can be placed. Water is pressed into the roll through the plating and, if used, the cloth-type mesh, and the water then exits through channels in the interior of the press rolls. At the edges of the press rolls edge rings are screwed in place along the peripheries of the end surfaces of the rolls. These edge rings function as sealing surfaces in the end seal on the press roll, as well as places where the cloth-type mesh, if used, can be attached. The wear surfaces on the edge rings wear down due to the fact that fibers pass through the seal while the pulp is being pressed, and since the edge rings cannot be repaired by welding due to risk of heat stress and the like. Each edge ring must therefore be considered a wear part and replaced. This is a complicated and time-consuming procedure which requires lifting the entire roll out of the roll press.

An object of the present invention is thus to solve the problem of replacing worn edge rings by providing an easily replaceable edge ring that requires a minimum of personal resources, tools and lifting equipment.

SUMMARY OF THE INVENTION

In accordance with the present invention, this and other objects have now been realized by the invention of apparatus for attachment to a press roll having an end including an edge and a peripheral surface, the apparatus comprising an edge ring extending around the edge of the press roll, the edge ring comprising a plurality of edge ring sectors dividing the edge ring diametrically, the plurality of edge ring sectors including a radial outer portion and a radial inner portion, the radial outer portion including a hook-shaped portion for forming a cap joint with the edge of the press roll. In a preferred embodiment, the hook-shaped portion of the edge roll includes an axially extending portion which forms a smooth continuous surface with the peripheral surface of the press roll and a radially extending portion for mating with the edge of the press roll.

In accordance with a preferred embodiment of the apparatus of the present invention, the radial inner portion of the edge roll includes a threaded joint portion for attachment to the end of the press roll. In a preferred embodiment, the end of the press roll includes an inwardly facing shoulder, and the edge ring includes an outwardly facing peripheral shoulder for contacting the inwardly facing shoulder of the press roll, the outwardly facing peripheral shoulder of the edge roll being located radially outwardly with respect to the threaded joint portion of the edge roll.

BRIEF DESCRIPTION OF THE DRAWINGS

The present invention may be more fully appreciated with reference to the following detailed description, which refers to the drawings, in which.

DETAILED DESCRIPTION

Figure 1:
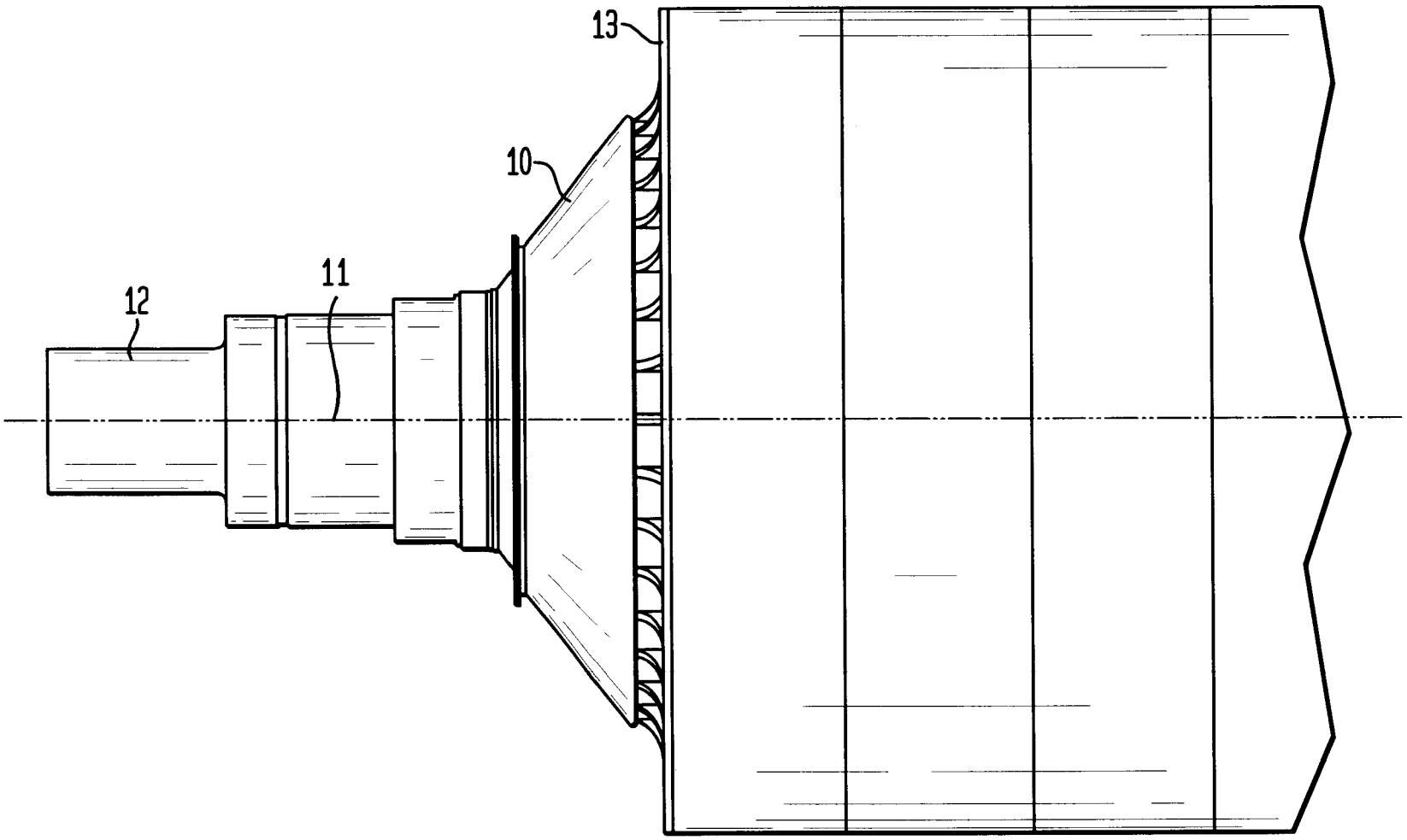
FIG. 1 is a side elevational view of one end of a press roll.

Referring to the drawings, FIG. 1 shows a plan view of one end of a press roll 10 in a roll press used for a stock suspension and mounted so that it can rotate around shaft 11 carried on shaft ends 12. The present invention relates to an edge ring 13 which extends around the edges of each end of the press roll 10.

Figure 2:
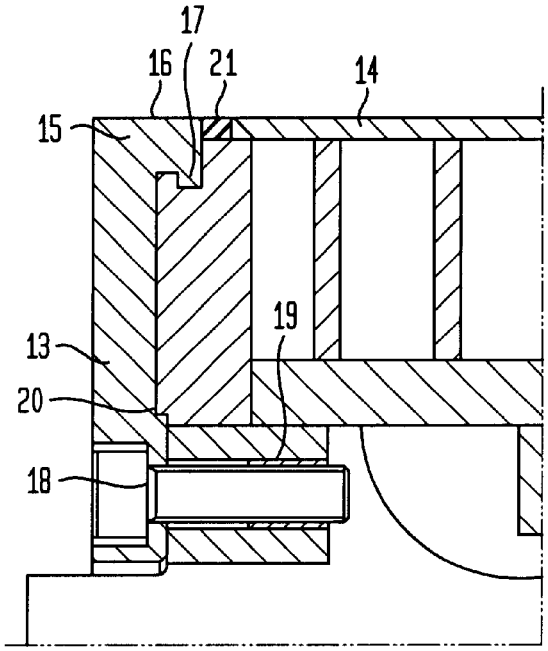
FIG. 2 is an enlarged side elevational, sectional view taken through a portion of the edge of the press roll shown in FIG. 1.
Figure 3:
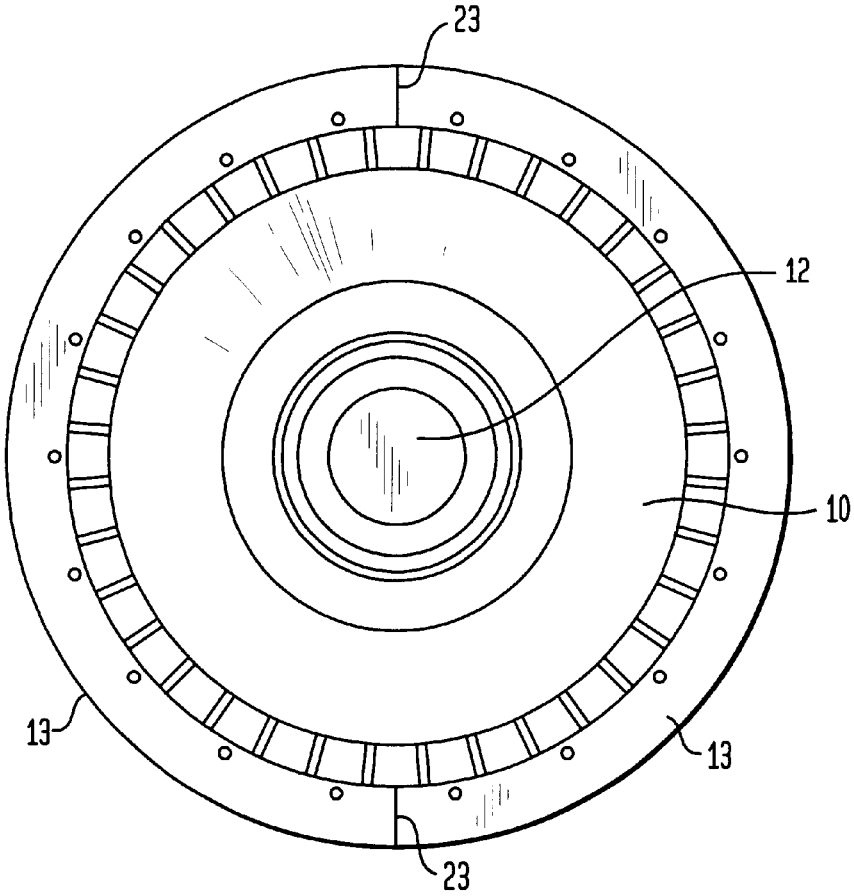
FIG. 3 is a front elevational view of the end of the press roll shown in FIG. 1.

FIG. 2 shows a large-scale cross-section taken through the edge of one end of the press roll 10. The peripheral shell surface of the roll consists of perforated plating 14 through which the stock suspension is dewatered. As is shown in FIG. 2, the radial outer end of edge ring 13 is shaped in the form of a hook 15 which has an axial portion 16 that is joined smoothly with the shell plating 14 on the press roll, and a radial turned-in portion 17 that mates with the end of the roll so that, together, they form a cap-type joint. By means of diametrical slits 23, edge ring 13 is divided radially into at least two sectors. In addition to the captype joint at the periphery, the edge-ring sectors are joined to the end of the roll by threaded joints between the radial inner portion of the ring sectors and the end of the press roll. These threaded joints are formed by screws 18 which are threaded into the end of the roll, in this case by means of tapered threaded inserts 19.

Outside of threaded joint, 18 and 19, edge ring 13 is provided with a radial, outward-facing peripheral shoulder 20 which contacts a corresponding inward-facing shoulder on the end of the press roll. Reference numeral 21 indicates a weld in the joint between edge ring 13 and shell plating 14.

Since, in accordance with the present invention, the edge ring is divided into two or more sectors, it is easily replaceable without dismounting the roll and without resorting to machinery. The edge ring can thus be considered a wear part. One feature of hook 15 on the edge ring is that it absorbs the radial load imposed from the press nip through part 16 and prevents, through part 17, the ring (ring sectors) from moving in the axial direction. Threaded joint, 18 and 19, functions as a driving member and absorbs rotational forces created by friction between the edge seal and the press roll. The small shoulder 20 on the inside of the ring makes it even more certain that the edge ring will not come loose during operation, even if screws 18 were to become loose. In this embodiment of the present invention, the mounting of the ring is made possible by its elasticity. The edge ring can be made from different materials which withstand wear better than normal stainless steel and acid-resistant steel and cause less friction.

Through this invention, the problems entailed by the wearing down of edge rings on press rolls are solved. Instead of having to dismount the roll from the machine in order to replace the edge ring, an easily replaceable edge ring is provided, thereby minimizing the need for personnel, tools and lifting equipment.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for attachment to a press roll having an end including an edge and a peripheral surface, said apparatus comprising an edge ring extending around said edge of said press roll, said edge ring comprising a plurality of edge ring sectors dividing said edge ring diametrically, said plurality of edge ring sectors including an outer portion and an inner portion, said outer portion being disposed outwardly from said inner portion, in a radial direction, said outer portion including a hook-shaped portion including an axially extending part and a radially extending part for preventing the edge ring from moving in an axial direction of the press roll and for forming a cap joint with said edge of said press roll.

2. The apparatus of claim 1 wherein said hook-shaped portion of said edge ring includes an axially extending portion which forms a smooth continuous surface with said peripheral surface of said press roll and a radially extending portion for mating with said edge of said press roll.

3. The apparatus of claim 2 wherein said radial inner portion of said edge roll includes a threaded joint portion for attachment to said end of said press roll.

4. The apparatus of claim 3 wherein said end of said press roll includes an inwardly facing shoulder, and wherein said edge ring includes an outwardly facing peripheral shoulder for contacting said inwardly facing shoulder of said press roll, said outwardly facing peripheral shoulder of said edge ring being located radially outwardly with respect to said threaded joint portion of said edge ring.

* * * * *